US007602374B2

(12) United States Patent
Zehner et al.

(10) Patent No.: US 7,602,374 B2
(45) **Date of Patent: *Oct. 13, 2009**

(54) METHODS FOR REDUCING EDGE EFFECTS IN ELECTRO-OPTIC DISPLAYS

(75) Inventors: Robert W. Zehner, Arlington, MA (US); Karl R. Amundson, Arlington, MA (US)

(73) Assignee: E Ink Corporation, Cambridge, MA (US)

( * ) Notice: Subject to any disclaimer, the term of this patent is extended or adjusted under 35 U.S.C. 154(b) by 596 days.

This patent is subject to a terminal disclaimer.

(21) Appl. No.: 10/711,420

(22) Filed: Sep. 17, 2004

(65) Prior Publication Data

US 2005/0062714 A1 Mar. 24, 2005

Related U.S. Application Data

(60) Provisional application No. 60/481,400, filed on Sep. 19, 2003.

(51) Int. Cl.
*G09G 3/34* (2006.01)
*G09G 5/02* (2006.01)

(52) U.S. Cl. ..... 345/107; 345/693

(58) Field of Classification Search ..... 345/107, 345/691–693

See application file for complete search history.

(56) References Cited

U.S. PATENT DOCUMENTS

| | | | | |
|---|---|---|---|---|
| 3,668,106 | A | | 6/1972 | Ota |
| 3,756,693 | A | | 9/1973 | Ota |
| 3,767,392 | A | | 10/1973 | Ota |
| 3,792,308 | A | | 2/1974 | Ota |
| 3,870,517 | A | | 3/1975 | Ota et al. |
| 3,892,568 | A | | 7/1975 | Ota |
| 4,418,346 | A | | 11/1983 | Batchelder |
| 4,448,493 | A | | 5/1984 | Matsudaira et al. |
| 4,550,982 | A | | 11/1985 | Hirai |
| 5,130,842 | A | | 7/1992 | Gauthier et al. |
| 5,684,504 | A | * | 11/1997 | Verhulst et al. ..... 345/97 |
| 5,745,094 | A | | 4/1998 | Gordon, II et al. |
| 5,760,761 | A | | 6/1998 | Sheridon |
| 5,777,782 | A | | 7/1998 | Sheridon |

(Continued)

FOREIGN PATENT DOCUMENTS

EP 1 145 072 B1 5/2003

(Continued)

OTHER PUBLICATIONS

Amundson, K., et al., "Flexible, Active-Matrix Display Constructed Using a Microencapsulated Electrophoretic Material and an Organic-Semiconductor-Based Backplane", SID 01 Digest, 160 (Jun. 2001).

(Continued)

*Primary Examiner*—Bipin Shalwala
*Assistant Examiner*—Steven E Holton
(74) *Attorney, Agent, or Firm*—David J. Cole

(57) ABSTRACT

Edge effects in electro-optic displays are reduced by (a) ensuring that during rewriting of the display, the last period of non-zero voltage applied all pixels terminates at substantially the same time; and (b) scanning the display at a scan rate of at least 50 Hz.

31 Claims, 4 Drawing Sheets

U.S. PATENT DOCUMENTS

| | | | |
|---|---|---|---|
| 5,784,190 | A | 7/1998 | Worley |
| 5,808,783 | A | 9/1998 | Crowley |
| 5,872,552 | A | 2/1999 | Gordon, II et al. |
| 5,891,366 | A | 4/1999 | Gruenwald et al. |
| 5,930,026 | A | 7/1999 | Jacobson et al. |
| 5,961,804 | A | 10/1999 | Jacobson et al. |
| 6,017,584 | A | 1/2000 | Albert et al. |
| 6,054,071 | A | 4/2000 | Mikkelsen, Jr. |
| 6,055,091 | A | 4/2000 | Sheridon et al. |
| 6,067,185 | A | 5/2000 | Albert et al. |
| 6,097,531 | A | 8/2000 | Sheridon |
| 6,118,426 | A | 9/2000 | Albert et al. |
| 6,120,588 | A | 9/2000 | Jacobson |
| 6,120,839 | A | 9/2000 | Comiskey et al. |
| 6,124,851 | A | 9/2000 | Jacobson |
| 6,128,124 | A | 10/2000 | Silverman |
| 6,130,773 | A | 10/2000 | Jacobson et al. |
| 6,130,774 | A | 10/2000 | Albert et al. |
| 6,137,467 | A | 10/2000 | Sheridon et al. |
| 6,140,405 | A | 10/2000 | Eckstein et al. |
| 6,144,361 | A | 11/2000 | Gordon, II et al. |
| 6,147,791 | A | 11/2000 | Sheridon |
| 6,172,798 | B1 | 1/2001 | Albert et al. |
| 6,177,921 | B1 | 1/2001 | Comiskey et al. |
| 6,184,331 | B1 | 2/2001 | Chiang et al. |
| 6,184,856 | B1 | 2/2001 | Gordon, II et al. |
| 6,225,971 | B1 | 5/2001 | Gordon, II et al. |
| 6,232,950 | B1 | 5/2001 | Albert et al. |
| 6,236,385 | B1 | 5/2001 | Nomura et al. |
| 6,241,921 | B1 | 6/2001 | Jacobson et al. |
| 6,249,271 | B1 | 6/2001 | Albert et al. |
| 6,252,564 | B1 | 6/2001 | Albert et al. |
| 6,262,706 | B1 | 7/2001 | Albert et al. |
| 6,262,833 | B1 | 7/2001 | Loxley et al. |
| 6,271,823 | B1 | 8/2001 | Gordon, II et al. |
| 6,300,932 | B1 | 10/2001 | Albert |
| 6,301,038 | B1 | 10/2001 | Fitzmaurice et al. |
| 6,312,304 | B1 | 11/2001 | Duthaler et al. |
| 6,312,971 | B1 | 11/2001 | Amundson et al. |
| 6,323,989 | B1 | 11/2001 | Jacobson et al. |
| 6,327,072 | B1 | 12/2001 | Comiskey et al. |
| 6,376,828 | B1 | 4/2002 | Comiskey |
| 6,377,387 | B1 | 4/2002 | Duthaler et al. |
| 6,392,785 | B1 | 5/2002 | Albert et al. |
| 6,392,786 | B1 | 5/2002 | Albert |
| 6,413,790 | B1 | 7/2002 | Duthaler et al. |
| 6,422,687 | B1 | 7/2002 | Jacobson |
| 6,445,374 | B2 | 9/2002 | Albert et al. |
| 6,445,489 | B1 | 9/2002 | Jacobson et al. |
| 6,459,418 | B1 | 10/2002 | Comiskey et al. |
| 6,473,072 | B1 | 10/2002 | Comiskey et al. |
| 6,480,182 | B2 | 11/2002 | Turner et al. |
| 6,498,114 | B1 | 12/2002 | Amundson et al. |
| 6,504,524 | B1 | 1/2003 | Gates et al. |
| 6,506,438 | B2 | 1/2003 | Duthaler et al. |
| 6,512,354 | B2 | 1/2003 | Jacobson et al. |
| 6,515,649 | B1 | 2/2003 | Albert et al. |
| 6,518,949 | B2 | 2/2003 | Drzaic |
| 6,521,489 | B2 | 2/2003 | Duthaler et al. |
| 6,531,997 | B1 | 3/2003 | Gates et al. |
| 6,535,197 | B1 | 3/2003 | Comiskey et al. |
| 6,538,801 | B2 | 3/2003 | Jacobson et al. |
| 6,545,291 | B1 | 4/2003 | Amundson et al. |
| 6,580,545 | B2 | 6/2003 | Morrison et al. |
| 6,639,578 | B1 | 10/2003 | Comiskey et al. |
| 6,652,075 | B2 | 11/2003 | Jacobson |
| 6,657,772 | B2 | 12/2003 | Loxley |
| 6,664,944 | B1 | 12/2003 | Albert et al. |
| D485,294 | S | 1/2004 | Albert |
| 6,672,921 | B1 | 1/2004 | Liang et al. |
| 6,680,725 | B1 | 1/2004 | Jacobson |
| 6,683,333 | B2 | 1/2004 | Kazlas et al. |
| 6,693,620 | B1 | 2/2004 | Herb et al. |
| 6,704,133 | B2 | 3/2004 | Gates et al. |
| 6,710,540 | B1 | 3/2004 | Albert et al. |
| 6,721,083 | B2 | 4/2004 | Jacobson et al. |
| 6,724,519 | B1 | 4/2004 | Comiskey et al. |
| 6,727,881 | B1 | 4/2004 | Albert et al. |
| 6,738,050 | B2 | 5/2004 | Comiskey et al. |
| 6,750,473 | B2 | 6/2004 | Amundson et al. |
| 6,753,999 | B2 | 6/2004 | Zehner et al. |
| 6,788,449 | B2 | 9/2004 | Liang et al. |
| 6,816,147 | B2 | 11/2004 | Albert |
| 6,819,471 | B2 | 11/2004 | Amundson et al. |
| 6,822,782 | B2 | 11/2004 | Honeyman et al. |
| 6,825,068 | B2 | 11/2004 | Denis et al. |
| 6,825,829 | B1 | 11/2004 | Albert et al. |
| 6,825,970 | B2 | 11/2004 | Goenaga et al. |
| 6,831,769 | B2 | 12/2004 | Holman et al. |
| 6,839,158 | B2 | 1/2005 | Albert et al. |
| 6,842,167 | B2 | 1/2005 | Albert et al. |
| 6,842,279 | B2 | 1/2005 | Amundson |
| 6,842,657 | B1 | 1/2005 | Drzaic et al. |
| 6,864,875 | B2 | 3/2005 | Drzaic et al. |
| 6,865,010 | B2 | 3/2005 | Duthaler et al. |
| 6,866,760 | B2 | 3/2005 | Paolini Jr. et al. |
| 6,870,657 | B1 | 3/2005 | Fitzmaurice et al. |
| 6,870,661 | B2 | 3/2005 | Pullen et al. |
| 6,900,851 | B2 | 5/2005 | Morrison et al. |
| 6,922,276 | B2 | 7/2005 | Zhang et al. |
| 6,950,220 | B2 | 9/2005 | Abramson et al. |
| 6,958,848 | B2 | 10/2005 | Cao et al. |
| 7,019,889 | B2 * | 3/2006 | Katase ..... 359/296 |
| 7,106,277 | B2 * | 9/2006 | Ando et al. ..... 345/58 |
| 2002/0027635 | A1 | 3/2002 | Sakamaki et al. |
| 2002/0060321 | A1 | 5/2002 | Kazlas et al. |
| 2002/0063661 | A1 | 5/2002 | Comiskey et al. |
| 2002/0090980 | A1 | 7/2002 | Wilcox et al. |
| 2002/0113770 | A1 | 8/2002 | Jacobson et al. |
| 2002/0130832 | A1 | 9/2002 | Baucom et al. |
| 2002/0180687 | A1 | 12/2002 | Webber |
| 2003/0011560 | A1 | 1/2003 | Albert et al. |
| 2003/0020844 | A1 | 1/2003 | Albert et al. |
| 2003/0102858 | A1 | 6/2003 | Jacobson et al. |
| 2003/0132908 | A1 | 7/2003 | Herb et al. |
| 2003/0137521 | A1 | 7/2003 | Zehner et al. |
| 2003/0151702 | A1 | 8/2003 | Morrison et al. |
| 2003/0222315 | A1 | 12/2003 | Amundson et al. |
| 2004/0014265 | A1 | 1/2004 | Kazlas et al. |
| 2004/0027327 | A1 | 2/2004 | LeCain et al. |
| 2004/0075634 | A1 | 4/2004 | Gates |
| 2004/0094422 | A1 | 5/2004 | Pullen et al. |
| 2004/0105036 | A1 | 6/2004 | Danner et al. |
| 2004/0112525 | A1 | 6/2004 | Pereira et al. |
| 2004/0112750 | A1 | 6/2004 | Jacobson et al. |
| 2004/0119681 | A1 | 6/2004 | Albert et al. |
| 2004/0136048 | A1 | 7/2004 | Arango et al. |
| 2004/0155857 | A1 | 8/2004 | Duthaler et al. |
| 2004/0180476 | A1 | 9/2004 | Kazlas et al. |
| 2004/0190114 | A1 | 9/2004 | Jacobson et al. |
| 2004/0196215 | A1 | 10/2004 | Duthaler et al. |
| 2004/0216837 | A1 | 11/2004 | Pereira et al. |
| 2004/0226820 | A1 | 11/2004 | Webber et al. |
| 2004/0239614 | A1 | 12/2004 | Amundson et al. |
| 2004/0252360 | A1 | 12/2004 | Webber et al. |
| 2004/0257635 | A1 | 12/2004 | Paolini, Jr. et al. |
| 2004/0263947 | A1 | 12/2004 | Drzaic et al. |
| 2005/0000813 | A1 | 1/2005 | Pullen et al. |
| 2005/0001812 | A1 | 1/2005 | Amundson et al. |
| 2005/0007336 | A1 | 1/2005 | Albert et al. |
| 2005/0007653 | A1 | 1/2005 | Honeyman et al. |
| 2005/0012980 | A1 | 1/2005 | Wilcox et al. |
| 2005/0017944 | A1 | 1/2005 | Albert |
| 2005/0018273 | A1 | 1/2005 | Honeyman et al. |

| | | | | |
|---|---|---|---|---|
| 2005/0024353 | A1 | 2/2005 | Amundson et al. | |
| 2005/0035941 | A1 | 2/2005 | Albert et al. | |
| 2005/0041004 | A1 | 2/2005 | Gates et al. | |
| 2005/0067656 | A1 | 3/2005 | Denis et al. | |
| 2005/0099672 | A1 | 5/2005 | Jacobson et al. | |
| 2005/0122563 | A1 | 6/2005 | Honeyman et al. | |
| 2005/0179641 | A1 * | 8/2005 | Zhou et al. | 345/107 |

FOREIGN PATENT DOCUMENTS

| | | |
|---|---|---|
| WO | WO 00/05704 | 2/2000 |
| WO | WO 00/36560 | 6/2000 |
| WO | WO 00/38000 | 6/2000 |
| WO | WO 00/67110 | 11/2000 |
| WO | WO 00/67327 | 11/2000 |
| WO | WO 01/07961 | 2/2001 |
| WO | WO 03/107315 | 12/2003 |

OTHER PUBLICATIONS

Au, J. et al., "Ultra-Thin 3.1-in. Active-Matrix Electronic Ink Display for Mobile Devices", IDW'02, 223 (2002).
Bach, U., et al., "Nanomaterials-Based Electrochromics for Paper-Quality Displays", Adv. Mater, 14(11), 845 (2002).
Bouchard, A. et al., "High-Resolution Microencapsulated Electrophoretic Display on Silicon", SID 04 Digest, 651 (2004).
Caillot, E. et al. "Active Matrix Electrophoretic Information Display for High Performance Mobile Devices", IDMC Proceedings (2003).
Chen, Y., et al., "A Conformable Electronic Ink Display using a Foil-Based a-Si TFT Array", SID 01 Digest, 157 (Jun. 2001).
Comiskey, B., et al., "An electrophoretic ink for all-printed reflective electronic displays", Nature, 394, 253 (1998).
Comiskey, B., et al., "Electrophoretic Ink: A Printable Display Material", SID 97 Digest (1997), p. 75.
Danner, G.M. et al., "Reliability Performance for Microencapsulated Electrophoretic Displays with Simulated Active Matrix Drive", SID 03 Digest, 573 (2003).
Drzaic, P., et al., "A Printed and Rollable Bistable Electronic Display", SID 98 Digest (1998), p. 1131.
Duthaler, G., et al., "Active-Matrix Color Displays Using Electrophoretic Ink and Color Filters", SID 02 Digest, 1374 (2002).
Henzen, A. et al., "An Electronic Ink Low Latency Drawing Tablet", SID 04 Digest, 1070 (2004).
Henzen, A. et al., "Development of Active Matrix Electronic Ink Displays for Handheld Devices", SID 03 Digest, 176, (2003).
Henzen, A. et al., "Development of Active Matrix Electronic Ink Displays for Smart Handheld Applications", IDW'02, 227 (2002).
Jacobson, J., et al., "The last book", IBM Systems J., 36, 457 (1997).
Jo, G-R, et al., "Toner Display Based on Particle Movements", Chem. Mater, 14, 664 (2002).
Kazlas, P. et al., "Card-size Active-matrix Electronic Ink Display", Eurodisplay 2002, 259 (2002).
Kazlas, P., et al., "12.1" SVGA Microencapsulated Electrophoretic Active Matrix Display for Information Applicances, SID 01 Digest, 152 (Jun. 2001).
Kitamura, T., et al., "Electrical toner movement for electronic paper-like display", Asia Display/IDW '01, p. 1517, Paper HCS1-1 (2001).
O'Regan, B. et al., "A Low Cost, High-efficiency Solar Cell Based on Dye-sensitized colloidal TiO2 Films", Nature, vol. 353, Oct. 24, 1991, 773-740.
Pitt, M.G., et al., "Power Consumption of Microencapsulated Electrophoretic Displays for Smart Handheld Applications", SID 02 Digest, 1378 (2002).
Webber, R., "Image Stability in Active-Matrix Microencapsulated Electrophoretic Displays", SID 02 Digest, 126 (2002).
Whitesides, T. et al., "Towards Video-rate Microencapsulated Dual-Particle Electrophoretic Displays", SID 04 Digest, 133 (2004).
Wood, D., "An Electrochromic Renaissance?" Information Display, 18(3), 24 (Mar. 2002).
Yamaguchi, Y., "Toner display using insulative particles charged triboelectrically", Asia Display/IDW '01, p. 1729, Paper AMD4-4 (2001).
Zehner, R. et al., "Drive Waveforms for Active Matrix Electrophoretic Displays", SID 03 Digest, 842 (2003).

* cited by examiner

METHODS FOR REDUCING EDGE EFFECTS IN ELECTRO-OPTIC DISPLAYS

CROSS REFERENCE TO RELATED APPLICATIONS

This application claims benefit of Provisional Application Ser. No. 60/481,400, filed Sep. 19, 2003.

This application is also related to:

(a) application Ser. No. 10/064,279, filed Jun. 28, 2002 (Publication No. 2003/0011867; now U.S. Pat. No. 6,657,772);

(b) copending application Ser. No. 10/064,389, filed Jul. 9, 2002 (Publication No. 2003/0025855);

(c) copending application Ser. No. 10/249,957, filed May 22, 2003 (Publication No. 2004/0027327);

(d) copending application Ser. No. 10/879,335, filed Jun. 29, 2004, (Publication No. 2005/0024353),which claims benefit of the Provisional Applications Ser. No. 60/481,040, filed Jun. 30, 2003; 60/481,053, filed Jul. 2, 2003; and 60/481,405, filed Sep. 22, 2003.

The aforementioned copending application Ser. No. 10/879,335 is also a continuation-in-part of copending application Ser. No. 10/814,205, filed Mar. 31, 2004, (Publication No. 2005/0001812), which itself claims benefit of the following Provisional Applications: (1) Ser. No. 60/320,070, filed Mar. 31, 2003; (2) Ser. No. 60/320,207, filed May 5, 2003; (3) Ser. No. 60/481,669, filed Nov. 19, 2003; (4) Ser. No. 60/481,675, filed Nov. 20, 2003; and (5) Ser. No. 60/557,094, filed Mar. 26, 2004.

The aforementioned copending application Ser. No. 10/814,205 is also a continuation-in-part of copending application Ser. No. 10/065,795, filed Nov. 20, 2002 (Publication No. 2003/0137521), which itself claims benefit of the following Provisional Applications: (6) Ser. No. 60/319,007, filed Nov. 20, 2001; (7) Ser. No. 60/319,010, filed Nov. 21, 2001; (8) Ser. No. 60/319,034, filed Dec. 18, 2001; (9) Ser. No. 60/319,037, filed Dec. 20, 2001; and (10) Ser. No. 60/319,040, filed Dec. 21, 2001.

The aforementioned copending application Ser. No. 10/879,335 is also related to application Ser. No. 10/249,973, filed May 23, 2003, which is a continuation-in-part of the aforementioned application Ser. No. 10/065,795. application Ser. No. 10/249,973 claims priority from Provisional Applications Ser. No. 60/319,315, filed Jun. 13, 2002 and Ser. No. 60/319,321, filed Jun. 18, 2002. The aforementioned copending application Ser. No. 10/879,335 is also related to copending application Ser. No. 10/063,236, filed Apr. 2, 2002 (Publication No. 2002/0180687).

The entire disclosures of the aforementioned applications, and of all U.S. patents and published and copending patent applications mentioned below, are herein incorporated by reference.

BACKGROUND OF INVENTION

This invention relates to methods for reducing edge effects in electro-optic displays. This invention is especially, though not exclusively, intended for use with electrophoretic displays, in particular particle-based electrophoretic displays.

Electro-optic displays comprise a layer of electro-optic material, a term which is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the patents and published applications referred to below describe electrophoretic displays in which the extreme states are white and deep blue, so that an intermediate "gray state" would actually be pale blue. Indeed, as already mentioned the transition between the two extreme states may not be a color change at all. The term "gray level" is used to refer to the number of different optical levels which a pixel of a display can assume, including the two extreme optical states; thus, for example, a display in which each pixel could be black or white or assume two different gray states between black and white would have four gray levels.

The terms "bistable" and "bistability" are used herein in their conventional meaning in the imaging art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in published U.S. patent application No. 2002/0180687 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

The term "impulse" is used herein in its conventional meaning in the imaging art of the integral of voltage with respect to time. However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

The electro-optic displays in which the methods of the present invention are used typically contain an electro-optic material which is a solid in the sense that the electro-optic material has solid external surfaces, although the material may, and often does, have internal liquid- or gas-filled space. Such displays using solid electro-optic materials may hereinafter for convenience be referred to as "solid electro-optic displays".

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed to applying an electric field thereto, thus rotating the bodies to various positions and varying which of the sections of the bodies is seen through a viewing surface. This type of electro-optic medium is typically bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002,14(11), 845. Nanochromic films of this type are also described, for example, in U.S. Pat. No. 6,301,038, International Application Publication No. WO 01/27690, and in U.S. Patent Application 2003/0214695. This type of medium is also typically bistable.

Another type of electro-optic display, which has been the subject of intense research and development for a number of years, is the particle-based electrophoretic display, in which a plurality of charged particles move through a suspending fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

Numerous patents and applications assigned to or in the names of the Massachusetts Institute of Technology (MIT) and E Ink Corporation have recently been published describing encapsulated electrophoretic media. Such encapsulated media comprise numerous small capsules, each of which itself comprises an internal phase containing electrophoretically-mobile particles suspended in a liquid suspending medium, and a capsule wall surrounding the internal phase. Typically, the capsules are themselves held within a polymeric binder to form a coherent layer positioned between two electrodes. Encapsulated media of this type are described, for example, in U.S. Pat. Nos. 5,930,026; 5,961,804; 6,017,584; 6,067,185; 6,118,426; 6,120,588; 6,120,839; 6,124,851; 6,130,773; 6,130,774; 6,172,798; 6,177,921; 6,232,950; 6,249,271; 6,252,564; 6,262,706; 6,262,833; 6,300,932; 6,312,304; 6,312,971; 6,323,989; 6,327,072; 6,376,828; 6,377,387; 6,392,785; 6,392,786; 6,413,790; 6,422,687; 6,445,374; 6,445,489; 6,459,418; 6,473,072; 6,480,182; 6,498,114; 6,504,524; 6,506,438; 6,512,354; 6,515,649; 6,518,949; 6,521,489; 6,531,997; 6,535,197; 6,538,801; 6,545,291; 6,580,545; 6,639,578; 6,652,075; 6,657,772; 6,664,944; 6,680,725; 6,683,333; 6,704,133; 6,710,540; 6,721,083; 6,727,881; 6,738,050; 6,750,473; and 6,753,999; and U.S. Patent Applications Publication Nos. 2002/0019081; 2002/0021270; 2002/0060321; 2002/0063661; 2002/0090980; 2002/0113770; 2002/0130832; 2002/0131147; 2002/0171910; 2002/0180687; 2002/0180688; 2002/0185378; 2003/0011560; 2003/0020844; 2003/0025855; 2003/0038755; 2003/0053189; 2003/0102858; 2003/0132908; 2003/0137521; 2003/0137717; 2003/0151702; 2003/0214695; 2003/0214697; 2003/0222315; 2004/0008398; 2004/0012839; 2004/0014265; 2004/0027327; 2004/0075634; 2004/0094422; 2004/0105036; 2004/0112750; and 2004/0119681; and International Applications Publication Nos. WO 99/67678; WO 00/05704; WO 00/38000; WO 00/38001; WO 00/36560; WO 00/67110; WO 00/67327; WO 01/07961; WO 01/08241; WO 03/107,315; WO 2004/023195; and WO 2004/049045.

Many of the aforementioned patents and applications recognize that the walls surrounding the discrete microcapsules in an encapsulated electrophoretic medium could be replaced by a continuous phase, thus producing a so-called polymer-dispersed electrophoretic display in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned 2002/0131147. Accordingly, for purposes of the present application, such polymer-dispersed electrophoretic media are regarded as sub-species of encapsulated electrophoretic media.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; and other similar techniques.) Thus, the resulting display can be flexible. Further, because the display medium can be printed (using a variety of methods), the display itself can be made inexpensively.

A related type of electrophoretic display is a so-called "microcell electrophoretic display". In a microcell electrophoretic display, the charged particles and the suspending fluid are not encapsulated within microcapsules but instead are retained within a plurality of cavities formed within a carrier medium, typically a polymeric film. See, for example, International Applications Publication No. WO 02/01281, and published US Application No. 2002/0075556, both assigned to Sipix Imaging, Inc.

Other types of electro-optic materials may also be used in the displays of the present invention.

Although electrophoretic media are often opaque (since, for example, in many electrophoretic media, the particles substantially block transmission of visible light through the display) and operate in a reflective mode, many electrophoretic displays can be made to operate in a so-called "shutter mode" in which one display state is substantially opaque and one is light-transmissive. See, for example, the aforementioned U.S. Pat. Nos. 6,130,774 and 6,172,798, and U.S. Pat. Nos. 5,872,552; 6,144,361; 6,271,823; 6,225,971; and 6,184,856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode.

In addition to the layer of electro-optic material, an electro-optic display normally comprises at least two other layers disposed on opposed sides of the electro-optic material, one of these two layers being an electrode layer. In most such displays both the layers are electrode layers, and one or both of the electrode layers are patterned to define the pixels of the display. For example, one electrode layer may be patterned into elongate row electrodes and the other into elongate column electrodes running at right angles to the row electrodes, the pixels being defined by the intersections of the row and column electrodes. Alternatively, and more commonly, one electrode layer has the form of a single continuous electrode and the other electrode layer is patterned into a matrix of pixel electrodes, each of which defines one pixel of the display. In another type of electro-optic display, which is intended for use with a stylus, print head or similar movable electrode separate from the display, only one of the layers adjacent the electro-optic layer comprises an electrode, the layer on the opposed side of the electro-optic layer typically being a protective layer intended to prevent the movable electrode damaging the electro-optic layer.

The manufacture of a three-layer electro-optic display normally involves at least one lamination operation. For example, in several of the aforementioned MIT and E Ink patents and applications, there is described a process for manufacturing an encapsulated electrophoretic display in which an encapsulated electrophoretic medium comprising capsules in a binder is coated on to a flexible substrate comprising indium-tin-oxide (ITO) or a similar conductive coating (which acts as one electrode of the final display) on a plastic film, the capsules/binder coating being dried to form a coherent layer of the electrophoretic medium firmly adhered to the substrate. Separately, a backplane, containing an array of pixel electrodes and an appropriate arrangement of conductors to connect the pixel electrodes to drive circuitry, is prepared. To form the final display, the substrate having the capsule/binder layer thereon is laminated to the backplane using a lamination adhesive. (A very similar process can be used to prepare an electrophoretic display useable with a stylus or similar movable electrode by replacing the backplane with a simple protective layer, such as a plastic film, over which the stylus or other movable electrode can slide.) In one preferred form of such a process, the backplane is itself flexible and is prepared by printing the pixel electrodes and conductors on a plastic film or other flexible substrate. The obvious lamination technique for mass production of displays by this process is roll lamination using a lamination adhesive. Similar manufacturing techniques can be used with other types of electro-optic displays. For example, a microcell electrophoretic medium or a rotating bichromal member medium may be laminated to a backplane in substantially the same manner as an encapsulated electrophoretic medium.

In the processes described above, the lamination of the substrate carrying the electro-optic layer to the backplane may advantageously be carried out by vacuum lamination. Vacuum lamination is effective in expelling air from between the two materials being laminated, thus avoiding unwanted air bubbles in the final display; such air bubbles may introduce undesirable artifacts in the images produced on the display. (As discussed below, it may be desirable to produce the final lamination adhesive by blending multiple components. If this is done, it may be advantageous to allow the blended mixture to stand for some time before use to allow bubbles produced during blending to disperse.) However, vacuum lamination of the two parts of an electro-optic display in this manner imposes stringent requirements upon the lamination adhesive used, as described in the aforementioned 2003/0011867 and 2003/0025855.

Also as described in these published applications, it has also been found that a lamination adhesive used in an electro-optic display must meet a variety of electrical criteria, and this introduces considerable problems in the selection of the lamination adhesive. Commercial manufacturers of lamination adhesives naturally devote considerable effort to ensuring that properties, such as strength of adhesion and lamination temperatures, of such adhesives are adjusted so that the adhesives perform well in their major applications, which typically involve laminating polymeric and similar films. However, in such applications, the electrical properties of the lamination adhesive are not relevant, and consequently the commercial manufacturers pay no heed to such electrical properties. Indeed, substantial variations (of up to several fold) have been observed in certain electrical properties between different batches of the same commercial lamination adhesive, presumably because the manufacturer was attempting to optimize non-electrical properties of the lamination adhesive (for example, resistance to bacterial growth) and was not at all concerned about resulting changes in electrical properties.

However, in electro-optic displays, in which the lamination adhesive is normally located between the electrodes which apply the electric field needed to change the electrical state of the electro-optic medium, the electrical properties of the adhesive become crucial. As will be apparent to electrical engineers, the volume resistivity of the lamination adhesive becomes important, since the voltage drop across the electro-optic medium is essentially equal to the voltage drop across the electrodes, minus the voltage drop across the lamination adhesive. If the resistivity of the adhesive layer is too high, a substantial voltage drop will occur within the adhesive layer, thus reducing the voltage drop across the electro-optic medium itself and either reducing the switching speed of the display (i.e., increasing the time taken for a transition between any two optical states of the display) or requiring an increase in voltage across the electrodes. Increasing the voltage across the electrodes in this manner is undesirable, since it increases the power consumption of the display, and may require the use of more complex and expensive control circuitry to handle the increased voltage involved. On the other hand, if the adhesive layer, which extends continuously across the display, is in contact with a matrix of electrodes, as in an active matrix display, the volume resistivity of the adhesive layer should not be too low, or lateral voltage leakage will occur between neighboring pixels. Such lateral voltage leakage can produce undesirable visible effects on the image seen on the display. The leakage may be visible as "edge ghosting", which is a residual image around the edge of a recently-switched area of the display. The leakage may also be visible as a fringing effect, blooming or gap-filling, in which the switched area extends beyond the boundaries of the switched pixels. This effect is illustrated in FIG. 1 of the accompanying drawings, which shows the iso-potential surfaces which occur when one pixel (on the left in FIG. 1) is being driven while an adjacent pixel (on the right in FIG. 1) is not being driven. The iso-potential surfaces marked in FIG. 1 are as follows:

| Reference Letter | Potential |
|---|---|
| max | 1.00 |
| k | 1.00 |
| j | 0.90 |
| i | 0.80 |
| h | 0.70 |
| g | 0.60 |
| f | 0.50 |
| e | 0.40 |
| d | 0.30 |

-continued

| Reference Letter | Potential |
|---|---|
| c | 0.20 |
| b | 0.10 |
| a | 0.00 |
| min | 0.00 |

It will be seen that the iso-potential surfaces extend substantially beyond the boundary of the driven pixel. On the other hand, when both pixels are driven simultaneously but in opposite directions (see FIG. 2), no blooming is present. The iso-potential surfaces marked in FIG. 2 are as follows:

| Reference Letter | Potential |
|---|---|
| max | 1.00 |
| g | 0.90 |
| f | 0.60 |
| e | 0.30 |
| d | 0.00 |
| c | −0.30 |
| b | −0.60 |
| a | −0.90 |
| min | −1.00 |

The precise conditions under which these effects become visible depend upon the type of electro-optic medium used, as well as the thicknesses of the electro-optic medium and adhesive layers. Also, the visible effects occur along a continuum, and setting points at which the effects become unacceptable is essentially arbitrary, and may vary depending upon the tolerance of the intended application of the display to either slow switching or field spreading/blurring. For example, obviously a display, such as an electronic book reader, intended only to display static images, can tolerate a much slower switching rate than a display, such as a cellular telephone display, which may sometimes be required to display video images.

While it is ordinarily desirable to maintain the conductivity of the lamination adhesive within a range which avoids such image problems, it may be necessary to increase the conductivity of the adhesive to a value which tends to cause such image defects to obtain improved switching speed, especially at temperatures substantially below room temperature, and such high conductivity adhesive may result in an increased amount of pixel blooming and edge ghosting. Furthermore, given all the other chemical and mechanical constraints upon the choice of lamination adhesive, as discussed in the aforementioned applications, there may be specific displays for which it is not reasonably possible to find a lamination adhesive which can completely avoid the image problems discussed above under all operating conditions, at least when using certain standardized drive schemes for such displays. Accordingly, it is desirable to be able to vary the drive scheme (i.e., the sequence of voltages and times of the various pulses used to effect transitions between the various optical states of the pixel of an electro-optic display) in order to reduce the aforementioned problems, and the present invention relates to methods using appropriately modified drive schemes.

SUMMARY OF INVENTION

Accordingly, in one aspect, this invention provides a method of driving an electro-optic display having a plurality of pixels each of which is capable of displaying at least three gray levels, the method comprising:

displaying a first image on the display; and rewriting the display to display a second image thereon by applying to each pixel a waveform effective to cause the pixel to change from an initial gray level to a final gray level, wherein, for all pixels undergoing non-zero transitions, the waveforms applied to the pixels have their last period of non-zero voltage terminating at substantially the same time.

This aspect of the invention may hereinafter be referred to as the "synchronized cut-off" method of the present invention. Also, for convenience the term "voltage cut-off" may be used to mean the end of the last period of non-zero voltage in a waveform.

The phrase "terminating at substantially the same time" is used herein to mean that the last period of non-zero voltage terminates at substantially the same time within the limitations imposed by the apparatus and driving method used. For example, when the synchronized cut-off method is applied to an active matrix display in which the rows of the display are scanned sequentially during a scan frame period, the waveforms are considered to terminate at substantially the same time provided they terminate in the same scan frame period, since the scanning method does not allow for more precise synchronization of the waveforms.

The terms "zero transition" and "non-zero transition" are used herein in the same manner as in the aforementioned copending application Ser. No. 10/879,335. A zero transition is one in which the initial and final gray levels of a pixel are the same, while a non-zero transition is one in which the initial and final gray levels of a pixel differ. Although a zero transition for a pixel of a bistable display may be effected by not driving the relevant pixel at all, for reasons explained in the aforementioned copending application Ser. No. 10/879,335 and other related applications referred to above, it is often desirable to effect some driving of a pixel even during a zero transition. When such driving of a pixel undergoing a zero transition is effected, it is generally desirable that the voltage cut-off of the zero transition waveform be effected at substantially the same time as the voltage cut-off for pixels undergoing non-zero transitions. Thus, in one form of the synchronized cut-off method of the present invention, in which at least one pixel undergoes a zero transition during which there is applied to that pixel at least one period of non-zero voltage, the last period of non-zero voltage applied to the pixel undergoing the zero transition terminates at substantially the same time as the last period of non-zero voltage applied to the pixels undergoing a non-zero transition.

In one form of the synchronized cut-off method of the present invention, the waveforms applied to the pixels have a last period of non-zero voltage of the same duration. In an especially preferred form, the waveforms applied to the pixels comprise a plurality of pulses, and the transitions between pulses occur at substantially the same time in all waveforms.

As already indicated, the synchronized cut-off method of the present invention is primarily intended for use with bistable electro-optic displays. Such displays may be of any other types previously discussed. Thus, for example, in this method the electro-optic display may comprise an electrochromic or rotating bichromal member electro-optic medium, an encapsulated electrophoretic medium or a microcell electrophoretic medium.

It has been found that the severity of edge effects is related to the ratio between the thickness of the electro-optic layer (as measured by the distance between the electrodes) and the spacing between adjacent pixels. The synchronized cut-off method of the present invention is especially useful when the electro-optic display comprises a layer of electro-optic material having first and second electrodes on opposed sides thereof, and the spacing between the first and second electrodes is at least about twice the spacing between adjacent pixels of the display. In such a method, the first electrode may extend across a plurality of pixels (and typically the entire display) while a plurality of second electrodes may be provided, each second electrode defining one pixel of the display, the second pixels being arranged in a two-dimensional array.

As discussed below with reference to the high scan rate method of the present invention, edge effects can also be reduced by using a high scan rate. The two techniques may be used simultaneously. Accordingly, in the synchronized cut-off method of the present invention, the rewriting of the display may be effected by scanning the display at a rate of at least about 50 Hz.

The synchronized cut-off method of the present invention may be used in pulse width modulated drive schemes in which the rewriting of the display is effected by applying to each pixel any one or more of the voltages −V, 0 and +V, where V is an arbitrary voltage. Also, for reasons explained in the aforementioned copending application Ser. No. 10/879,335, with many electro-optic media it is desirable that the drive scheme used be DC balanced, in the sense that the rewriting of the display is effected such that, for any series of transitions undergone by a pixel, the integral of the applied voltage with time is bounded. Furthermore, for reasons described in the same application, it is desirable that the rewriting of the display be effected such that the impulse applied to a pixel during a transition depends only upon the initial and final gray levels of that transition.

For reasons explained in more detail below, in the synchronized cut-off method, at least one waveform may have as its last period of non-zero voltage a series of pulses of alternating polarity. The voltage applied during these pulses of alternating polarity may be equal to the highest voltage used during the waveform. Also, the duration of each of the pulses of alternating polarity may be not greater than about one-tenth of the duration of a pulse needed to drive a pixel from one extreme optical state to the other.

In another aspect, this invention provides an electro-optic display arranged to effect the synchronized cut-off method of the present invention. This electro-optic display has a plurality of pixels, each of which is capable of displaying at least three gray levels, at least one pixel electrode being associated with each pixel and capable of applying an electric field thereto. The display further comprises drive means for applying waveforms to the pixel electrodes, the drive means being arranged so that, for all pixels undergoing non-zero transitions, the waveforms applied to the pixels have their last period of non-zero voltage terminating at substantially the same time.

As already indicated, in another aspect this invention provides a method, conveniently referred to as the "high scan rate method" of driving a display. This method of driving an electro-optic display having a plurality of pixels each of which is capable of displaying at least two gray levels, comprises:

displaying a first image on the display; and rewriting the display to display a second image thereon by applying to each pixel a waveform effective to cause the pixel to change from an initial gray level to a final gray level, wherein the rewriting of the display is effected by scanning the display at a rate of at least about 50 Hz.

In this high scan rate method of the present invention, the rewriting of the display may be effected by scanning the display at a rate of at least about 60 Hz, and preferably at least about 70 Hz.

The high scan rate method of the present invention is primarily intended for use with bistable electro-optic displays. Such displays may be of any other types previously discussed. Thus, for example, in this method the electro-optic display may comprise an electrochromic or rotating bichromal member electro-optic medium, an encapsulated electrophoretic medium or a microcell electrophoretic medium.

As already noted, it has been found that the severity of edge effects is related to the ratio between the thickness of the electro-optic layer (as measured by the distance between the electrodes) and the spacing between adjacent pixels. The high scan rate method of the present invention is especially useful when the electro-optic display comprises a layer of electro-optic material having first and second electrodes on opposed sides thereof, and the spacing between the first and second electrodes is at least about twice the spacing between adjacent pixels of the display. In such a method, the first electrode may extend across a plurality of pixels (and typically the entire display) while a plurality of second electrodes may be provided, each second electrode defining one pixel of the display, the second pixels being arranged in a two-dimensional array.

In one form of the high scan rate method of the present invention, the electro-optic display comprises a layer of electro-optic material having first and second electrodes on opposed sides thereof, the first electrode extends across a plurality of pixels, and a plurality of second electrode are provided, each second electrode defining one pixel of the display, the second electrodes being disposed in a plurality of rows, and the scanning of the display is effected by selecting each row in succession, one complete scan of the display being the period required to select all rows of the display.

The high scan rate method of the present invention may be used in pulse width modulated drive schemes in which the rewriting of the display is effected by applying to each pixel any one or more of the voltages −V, 0 and +V. Also, for reasons explained in the aforementioned copending application Ser. No. 10/879,335, with many electro-optic media it is desirable that the drive scheme used by DC balanced, in sense that the rewriting of the display is effected such that, for any series of transitions undergone by a pixel, the integral of the applied voltage with time is bounded. Furthermore, for reasons described in the same application, it is desirable that the rewriting of the display be effected such that the impulse applied to a pixel during a transition depends only upon the initial and final gray levels of that transition.

For reasons explained in more detail below, in the high scan rate method, at least one waveform may have as its last period of non-zero voltage a series of pulses of alternating polarity. The voltage applied during these pulses of alternating polarity may be equal to the highest voltage used during the waveform. Also, the duration of each of the pulses of alternating polarity may be not greater than about one-tenth of the duration of a pulse needed to drive a pixel from one extreme optical state to the other.

In another aspect, this invention provides an electro-optic display arranged to effect the high scan rate method of the present invention. This electro-optic display has a plurality of pixels, each of which is capable of displaying at least two gray levels, the pixels being divided into a plurality of groups, and at least one pixel electrode being associated with each pixel and capable of applying an electric field thereto. The display further comprises drive means for applying waveforms to the pixel electrodes, the drive means being arranged to select each of the groups of pixels in turn, wherein all the groups of pixels are selected within a period of not more than about 20 milliseconds.

BRIEF DESCRIPTION OF DRAWINGS

As already indicated.

DETAILED DESCRIPTION OF INVENTION

Figure 6:
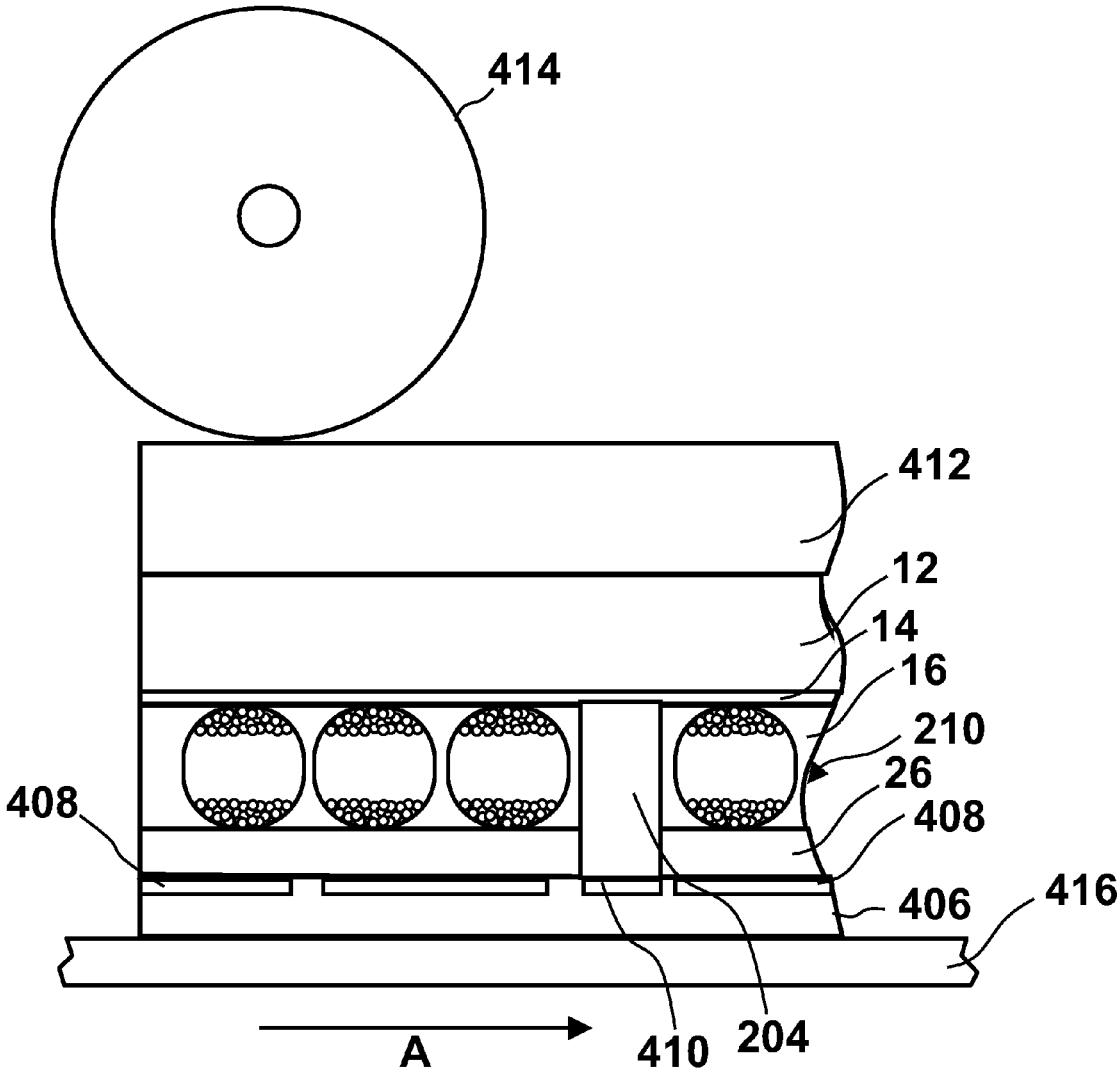
FIG. 6 schematic cross-section showing a front plane laminate being used in an intermediate stage of a process to form an electro-optic display of the present Invention.

FIG. 6 illustrates schematically a front plane laminate 210 being laminated to a backplane 406 provided with pixel electrodes 408 and a contact pad 410. The front plane laminate 210 comprises a light transmissive substrate 12. The substrate 12 carries a thin light-transmissive electrically-conductive layer 14 which acts as the front electrode in the final display. A layer (generally designated 16) of an electro-optic medium is deposited upon, and in electrical contact with, the conductive layer 14. The electro-optic medium shown in FIG. 6 is an opposite charge dual particle encapsulated electrophoretic medium and comprises a plurality of microcapsules. The microcapsules are retained within a binder. The laminate 210 further comprises a layer 26 of lamination adhesive coated over the electro-optic medium layer 16.

FIG. 6 shows a protective layer 412 being laminated over the substrate 12 of the front plane laminate 10 simultaneously with the lamination of the front plane laminate to the backplane 406. Although provision of such a protective layer is desirable for reasons discussed below, the protective layer need not be attached in the same lamination as that used to laminate the front plane laminate to the backplane, and typically the protective layer will be applied in a second lamination after the front plane laminate has been laminated to the backplane. Alternatively, the protective layer 412 could be applied to the substrate 12 before the electro-optic medium 16 is applied to the substrate.

FIG. 6 shows the lamination being effected using a roller 414 and a moveable heated stage 416 which, during the lamination process, is moved in the direction of arrow A. The backplane 406 is placed on the stage 416, and a cut piece of front plane laminate 210 is placed over the backplane 406, the front plane laminate 210 and the backplane 406 preferably being aligned using pre-positioned alignment reference markers, e.g., edge references, to control alignment in both directions parallel to the plane of stage 416 to achieve precision alignment of the two components prior to lamination. Protective layer 412 may then be placed over front plane laminate 210.

Once aligned, protective layer 412, front plane laminate 210 and backplane 406 are laminated together by advancing stage 416 in the direction of arrow A under roller 414, while the stack of material on stage 416 is held at a specific elevated temperature, desirably in the range of 50-150° C., and preferably in the range of 80-110° C. for hot melt adhesives such as ethylene vinyl acetate. Roller 414 may be heated or unheated, and applies a pressure desirably in the range of 0.2 to 0.5 MPa and preferably in the range of 0.35 to 0.5 MPa. The lamination adhesive layer is preferably temperature-and pressure-activated, so that the heat and pressure of the lamination laminate front plane laminate 210 and backplane 406 together as the stack passes under roller 414, thus forming an electro-optic display. It will be seen from FIG. 6 that the lamination is arranged to that the conductive via 204 contacts the contact pad 410, while the electro-optic medium becomes disposed adjacent the pixel electrodes 408; it is of course necessary that the contact pad 410 be electrically isolated from the pixel electrodes 408 in order that the potentials applied to the common front electrode formed by the conductive layer of the front plane laminate and the pixel electrodes can be varied independently to generate electric fields across the electro-optic medium sufficient to change the optical state thereof.

The lamination process can be varied in numerous ways. For example, the stage 416 could remain stationary and the roller 414 move. Both the roller 414 and the stage 416 could be unheated, and the lamination adhesive pressure-activated by the pressure applied by the roller 414. The lamination could of course also be carried out using two rollers (heated or unheated) rather than one roller and a stage.

Figure 1:
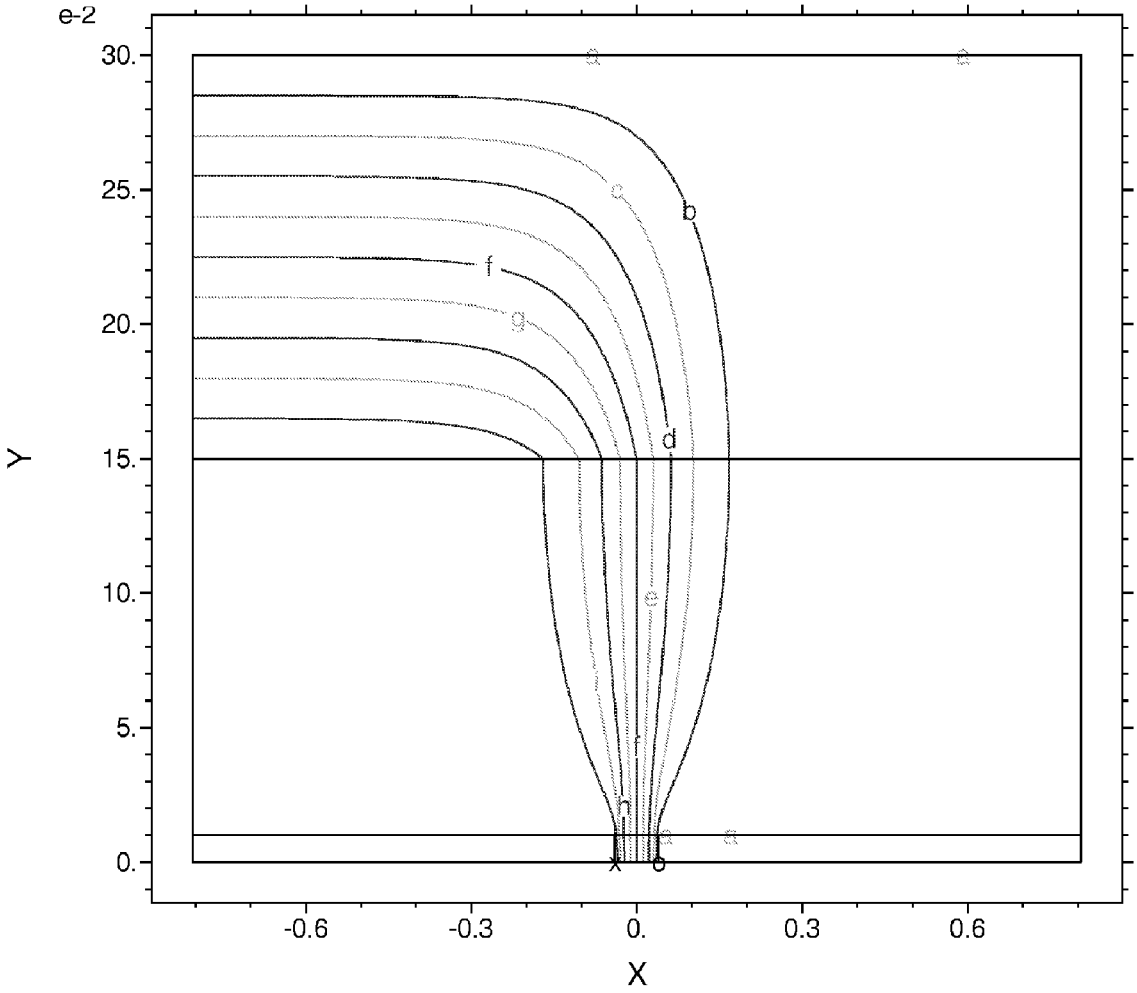
FIG. 1 illustrates the iso-potential surfaces which occur when one pixel (to the left in FIG. 1) is being driven while an adjacent pixel (to the right in FIG. 1) is not being driven.
Figure 2:
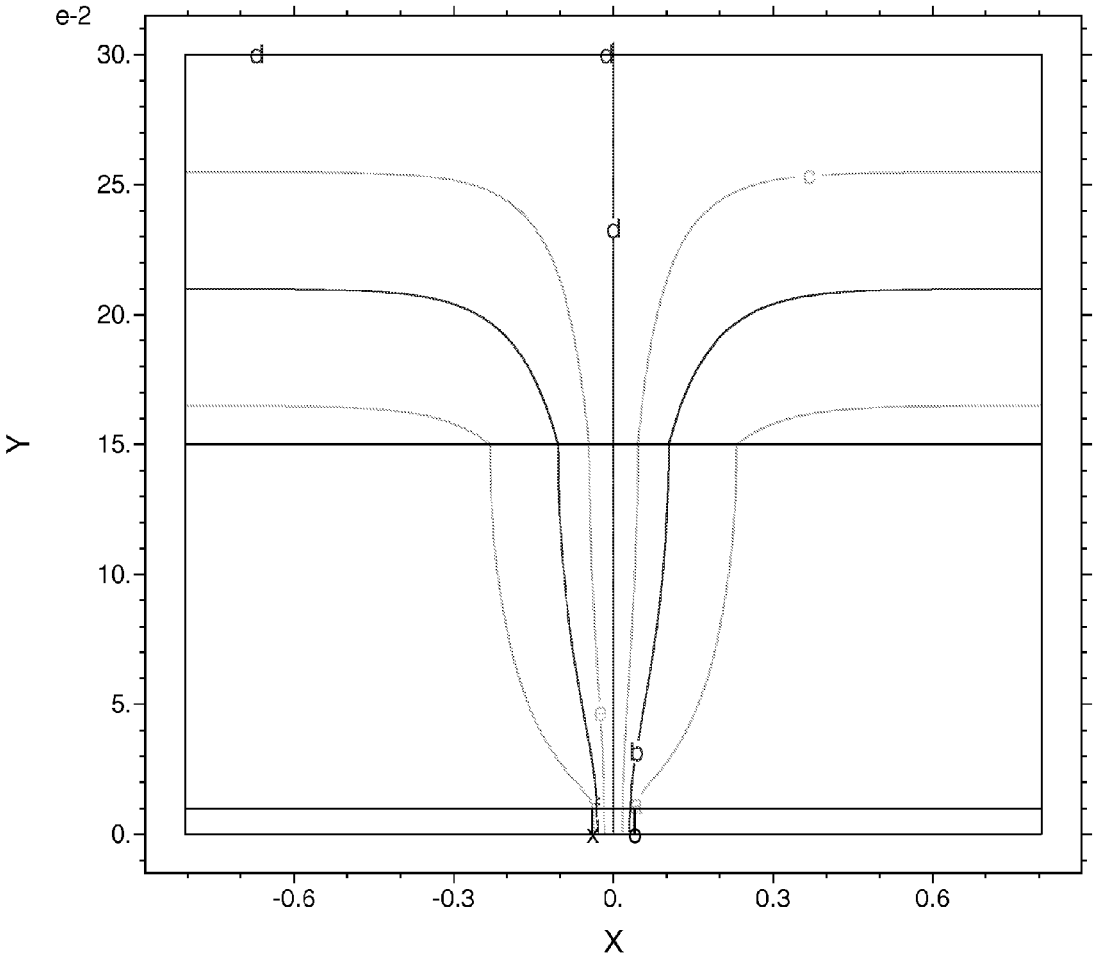
FIG. 2 shows the iso-potential surfaces which occur when both pixels shown in FIG. 1 are being driven simultaneously, but in opposite directions.

In order to understand the reasons why the methods of the present invention reduce edge effects in electro-optic displays, it is first desirable to return to FIGS. 1 and 2 of the accompanying drawings. Both these Figures show iso-potential surfaces which are generated in a model electro-optic display which has the conventional arrangement of a common front electrode, which extends across the whole display, a layer of electro-optic medium adjacent the common front electrode, a layer of lamination adhesive on the opposed side of the electro-optic medium to the front electrode, and a plurality of pixel electrodes, arranged in a regular two-dimensional array, on the opposed side of the lamination adhesive from the electro-optic medium. FIGS. 1 and 2 assume typical values for the conductivities of the lamination adhesive and the electro-optic medium, but the main features of the iso-potential surfaces are not very sensitive to the exact conductivities assumed.

It will be seen from FIG. 1 that, when one pixel is being driven (i.e., the pixel electrode for that pixel is being held at the same potential as the common front electrode) and an adjacent pixel is not, the iso-potential surfaces in effect bow away from the driven pixel (on the left in FIG. 1) and extend a substantial distance into the adjacent non-driven pixel. Since the electric field and hence current run perpendicular to the iso-potential surfaces, the effect of this bowing of the iso-potential surfaces is to cause the change in optical state of the electro-optic medium caused by the driven to extend across an area greater than that of the driven pixel, and effect known as "blooming". Furthermore, if the electro-optic medium is of a type, for example an electrophoretic medium, which requires application of a driving electric field for a significant period (typically of the order of a few hundred milliseconds) for a full transition between its extreme optical states, because of the way in which the iso-potential surfaces curve, the optical transition will be slower in the portions of the electro-optic medium which lie outside the area of the driven pixel, with the rate of transition decreasing as one moves away from the driven pixel. The result is that, if the situation in FIG. 1 persists for a substantial period of time, the visible extent of the blooming increases with time.

As already noted, in the situation shown in FIG. 2, in which both pixels are driven simultaneously but in opposite directions, no blooming occurs. (Furthermore, obviously blooming is not a problem if both pixels are driven simultaneously in the same direction.) If one switches a display which has been in the FIG. 1 situation or a substantial period, so that substantial blooming is already present, to the FIG. 2 situation, a relaxation effect occurs causing the extent of blooming to decrease with time. Thus, blooming which has been brought about in a situation such as that shown in FIG 1 can be removed by placing the display in the FIG. 2 situation (or the similar situation in which both pixels are driven simultaneously in the same direction) for a period sufficient to allow the blooming to disappear.

In practice, when an electro-optic display having a large number of pixels (for example a 640×480 VGA display) is being used to display arbitrary gray scale images, it is inevitable that the FIG. 1 situation will occur between certain pairs of adjacent pixels during certain parts of a rewriting of the display, and hence that some blooming will be produced. However, this blooming can be eliminated by ensuring that, during the last period when any driving voltage is being applied during a rewrite of the display all adjacent pairs of pixels are either in the FIG. 2 situation, or in the similar situation in which both pixels are being driven simultaneously in the same direction. Hence, the synchronized cut-off method of the present invention greatly reduces or even eliminates blooming.

It should be noted that the synchronized cut-off method of the present invention does not require that all pixels be driven right to the end of each waveform, only that the cut-off of drive voltage to each pixel be substantially simultaneous. It is common practice to reduce all drive voltages to zero (i.e., to set all the pixel electrodes to the same voltage as the common front electrode) for some period at the end of a rewrite of an electro-optic display in order to prevent residual voltages remaining on certain pixel electrodes causing "drift" in the gray levels of certain pixels after the rewrite. The synchronized cut-off method is compatible with the use of such a zero drive voltage period at the end of a rewrite.

Since, in the synchronized cut-off method, there must be one period when every pixel of the display is being driven, this method requires a "global update" waveform, i.e., a waveform in which every pixel of the display is simultaneously updated, regardless of whether it is remaining in the same state or not. It is not necessary that all pixels be driven for the same length of time; it may be advantageous to drive pixels that are remaining in the extreme white or black state for only a brief period. The drive scheme is chosen so that the drive pulses are "end-justified", with all the pixels being driven together at the end of a transition. As already noted, such end justification helps to ensure that any blooming that occurred in the early part of a transition is at least partially eliminated by the final common portion of the drive pulse.

The synchronized cut-off method may include appending one or more shaking pulses (a series of short pulses of alternating polarity, typically using the highest voltage available) to the end of the waveform used for a transition. These shaking pulses may be effected at the nominal scan rate of the display, or they may take place at a higher or lower rate. Typically, the duration of each shaking pulse will be not greater than about one-tenth of the duration of a pulse needed to drive a pixel from one extreme optical state to the other. In the simplest case, the frequency of these shaking pulses can be cut in half by using double frames, e.g. +15/+15/−15/−15, or in thirds by using three frames, etc. In order to minimize the effects of these shaking pulses on the contrast of the display, they may optionally only be applied to pixels in the black and white states, but not to pixels in the gray states. Additionally, the phase of the shake-up sequence may be adjusted based on the final image state of the pixel, so that pixels to be left in black and/or dark gray end the shaking sequence with a +15 V segment, while pixels to be left in white and/or light gray end with a 15 V segment, so as to reinforce the final optical state.

A global update waveform, such as the synchronized cut-off method, may present difficulties in interactive displays, where data is entered via a keyboard, or the display is controlled via a mouse, touch pad, or other scrolling device. In these cases, an update of even a small portion of the display (e.g. to show a new character in a text box or the selection of a radio button) will result in flashing of the entire display. This flashing effect can be avoided by including a reinforcing ("top-up") pulse that writes white and black pixels further to white and black. Such "top-up" pulses have been previously described, for example in the aforementioned copending application Ser. No. 10/249,973.

Another solution to the global waveform problem is to maintain global updates for updates taking place on grayscale pixels, while using updates with a local character (no impulses applied to intermediate gray level pixels which are not changing their optical state, although black and white pixels remaining in the same state may receive top-up pulses) for black/white-only updates. This type of dual updating avoids flashing during text entry or text scrolling by restricting the values of the pixels in the area to be updated to 1-bit (monochrome) values. For example, before text entry, a bounding box of a solid color (black or white) may be created in the appropriate location on the display (this update would use a global waveform and would involve flashing), after which the text entry takes place using local updating in monochrome with the text being rendered without the use of gray tones; thus the text entry would not result in flashing of the display. Similarly, a menu screen with multiple check boxes, buttons or similar devices selectable by the user can handle the updating needed to shown selection of check boxes etc. without flashing if both the check boxes and the adjoining areas are rendered solely in black and white.

The synchronized cut-off method of the present invention is compatible with the various types of preferred waveforms described in the aforementioned copending application Ser. Nos. 10/814,205 and 10/879,335. For example, these applications describe a preferred waveform of the type −TM(R1, R2) [IP(R1)−IP(R2)]TM(R1,R2). where [IP(R1)−IP(R2)] denotes a difference in impulse potential between the final and initial states of the transition being considered, while the two remaining terms represent a DC balanced pair of pulses. For convenience this waveform will hereinafter be referred to as the −x/ΔIP/x waveform, and is illustrated in FIG. 3.

In such a waveform, the ΔIP portion will of course vary with the particular transition being effected, and the duration of the "x" pulses may also vary from transition to transition. However, this type of waveform can always be made compatible with the synchronized cut-off method. The waveform shown in FIG. 3 may be appropriate for a transition between the extreme optical states (say from black to white) so that the ΔIP portion has its maximum duration. FIG. 4 illustrates a second waveform from the same drive scheme as FIG. 3, this second waveform being used for a black to gray transition. The waveform of FIG. 4 has the same −x and x pulses as the waveform in FIG. 3, but the duration of the central portion, designated "Δ'IP" is less than that of the waveform of FIG. 3, a period of zero voltage being inserted after Δ'IP to permit the x pulse in FIG. 4 to begin at the same time as the corresponding pulse in FIG. 3. Note that in some cases ΔIP may be negative, so the central portion of the waveform has the opposite polarity from that shown in FIGS. 3 and 4, but such a change in polarity has not effect on the general nature of the waveform.

Figure 3:
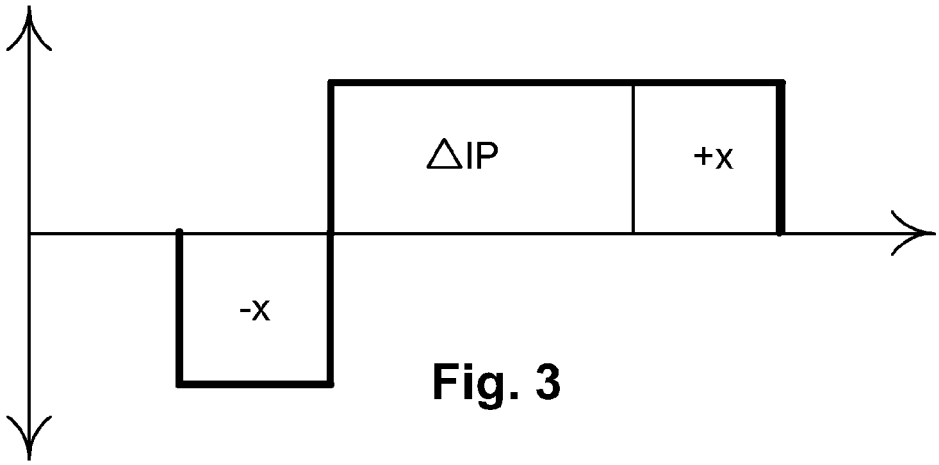
FIGS. 3, 4 and 5 show three waveforms which may be used for different transitions of an electro-optic display in a synchronized cut-off driving method of the present invention.
Figure 4:
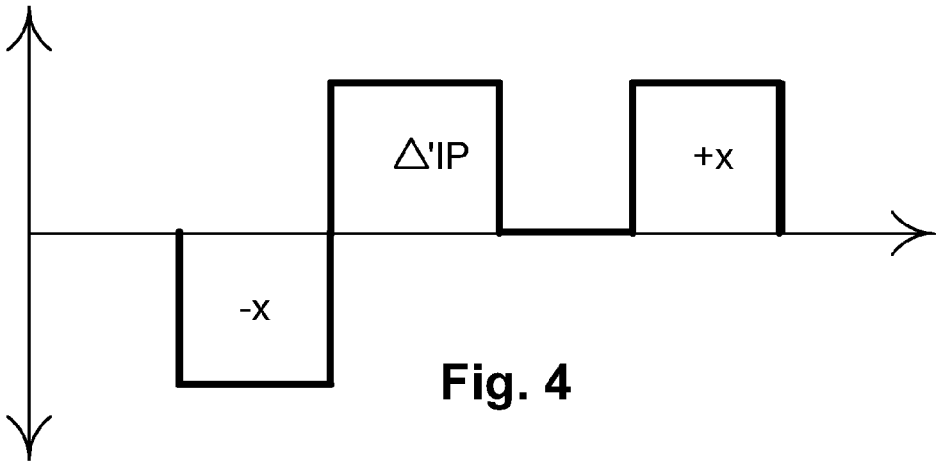
Figure 5:
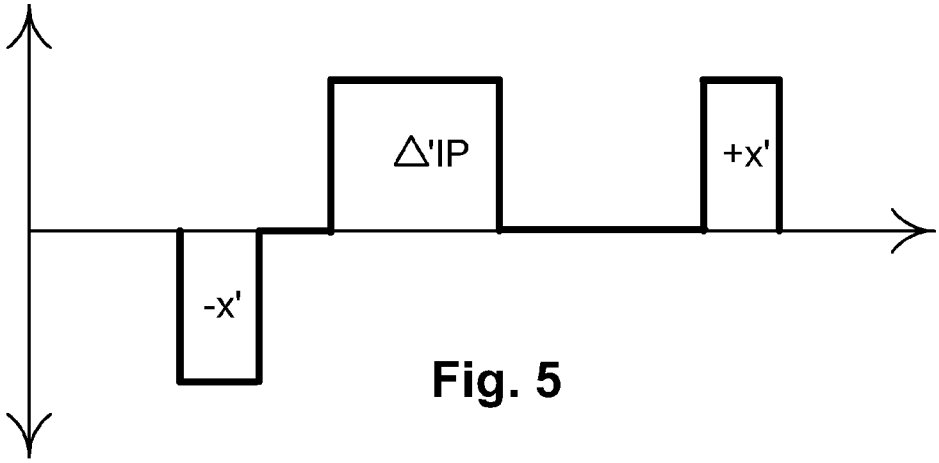

FIG. 5 shows a further waveform from the same drive scheme as FIGS. 3 and 4. The waveform of FIG. 5 has a central portion Δ'IP which is the same as the corresponding waveform portion in FIG. 4, but a pair of pulse (denoted "−x'" and "x'") which are of shorter duration than the corresponding pulses shown in FIGS. 3 and 4. A period of zero voltage is inserted between the −x' pulse and the Δ'IP pulse, and the period of zero voltage after the Δ'IP pulse is lengthened so that the x' pulse terminates at the same time as the x pulse in FIGS. 3 and 4. Thus, when the waveforms of FIGS. 3, 4 and 5 are applied simultaneously to three different pixels of a display, all three pixels are driven simultaneously for the duration of the final x' pulse in FIG. 5. By extension, it will be seen that if the waveforms used for all transitions are of the type illustrated in FIGS. 3, 4 and 5, at the end of the waveforms all the pixels will be driven simultaneously for the period corresponding to the shortest x pulse of any of the waveforms, thus effecting a synchronized cut-off driving method in accordance with the present invention.

In some cases, the value of x may be negative so that the −x and x pulses have opposite polarities from those shown in FIGS. 3, 4 and 5. However, this does not affect the fact that in such a method at the end of the waveforms all the pixels will be driven simultaneously for the period corresponding to the shortest x pulse of any of the waveforms. Also, for zero transitions the duration of the ΔIP pulse becomes zero, so that the waveform is reduced to the −x and x pulses, but again this does not affect the synchronized cut-off nature of the driving method.

The high scan rate method of the present invention will now be discussed. As noted in the discussion of FIGS. 1 and 2 above, blooming increases with the time for which an adjacent pair of pixels are in the FIG. 1 situation, with one pixel being driven while the adjacent pixel is not driven. Hence, the magnitude of the blooming effect is a function of the length of the pixel drive pulse. A longer drive pulse applied to a single pixel or region of the display will cause the image being written to bloom into neighboring pixels. Accordingly, the blooming effect can be reduced by shortening the length of the applied drive pulse, and thus by increasing the scan rate of the display, since a high scan rate necessarily limits the maximum duration of specific drive pulse to a low value. Specifically, it may be desirable to use a drive pulse shorter than that required to maximize the reflectivity of the white state and the contrast ratio of the display.

As already mentioned, a low-resistivity lamination adhesive tends to allow charge to leak between neighboring pixels. As a result, if in an active matrix display having a pixel electrode associated with each pixel and a common front electrode, one pixel is intended not be driven and thus to be held at zero voltage with respect to the common front electrode, charge from a neighboring pixel, which is being driven, may leak on to that pixel and make the voltage of the pixel electrode different from that of the common front electrode. The associated pixel of the electro-optic medium will then begin to switch in response to the applied electric field caused by the difference in voltage between the nominally non-driven pixel electrode and the front electrode. Conversely, the driven pixel will have lost some charge to the nominally non-driven pixel, which will reduce the effective drive voltage of the driven pixel, and thus is likely to produce under-driving of this pixel (so that, for example, the driven pixel might only achieve a light gray state rather than the extreme white state to which it was intended to be driven). These opposing effects on the two pixels can be minimized by increasing the scan rate of the TFT. At a higher scan rate, the leaked charge will be drained from the non-driven pixel electrode more frequently, thus minimizing the voltage excursion of the non-driven pixel. Likewise, the charge that leaked from the driven pixel will be replenished more rapidly, and thus the under-driving of this pixel will also be minimized.

In accordance with the fast scan method of the present invention, rewriting of an electro-optic display is effected using a scan rate of at least about 50H, desirably at least about 60 Hz, and preferably at least about 75 Hz. In general, it is desirable to use the highest scan rate compatible with good performance from the particular drive circuitry used, although power consumption may be a limiting factor in increasing scan rate, especially in the case of portable or other battery-driven displays.

Blooming can also be reduced by increasing the size of the pixel storage capacitors often provided on electro-optic displays. Such storage capacitors are provided to enable driving of the electro-optic medium to be continued even when the relevant line of pixels are not selected, as described in, for example, the aforementioned WO 01/07961and WO 00/67327, and in U.S. patent Publication No. 2002/0106847 (now U.S. Pat. No. 6,683,333 ). Increasing pixel capacitance reduces the voltage applied to a non-driven pixel as a result of a given amount of charge leakage between pixels, and thus reduces the undesirable effects on the image of such charge leakage. However, increasing the size of the pixel storage capacitors requires redesign of the active matrix backplane, whereas the changes in drive schemes mentioned above can be implemented by a minor electronics change, or in software.

It will be apparent to those skilled in the art that numerous changes can be made in the specific embodiments of the present invention already described without departing from the spirit scope of the invention. Accordingly, the whole of the foregoing description is to be construed in an illustrative and not in a limitative sense.

What is claimed is:

1. A method of driving an electro-optic display having a plurality of pixels each of which is capable of displaying at least three gray levels, the method comprising:

displaying a first image on the display; and rewriting the display to display a second image thereon by applying to each pixel a waveform effective to cause the pixel to change from an initial gray level to a final gray level, wherein, for all pixels undergoing non-zero transitions, the waveforms applied to the pixels have their last period of non-zero voltage terminating at substantially the same time; and wherein at least one pixel undergoes a zero transition during which there is applied to that pixel at least one period of non-zero voltage, and wherein the last period of non-zero voltage applied to the pixel undergoing the zero transition terminates at substantially the same time as the last period of non-zero voltage applied to the pixels undergoing a non-zero transition.

2. A method according to claim 1 wherein the waveforms applied to the pixels have a last period of non-zero voltage of the same duration.

3. A method according to claim 2 wherein the waveforms applied to the pixels comprise a plurality of pulses, and the transitions between pulses occur at substantially the same time in all waveforms.

4. A method according to claim 1 wherein the electro-optic display is bistable.

5. A method according to claim 4 wherein the electro-optic display comprises an electrochromic or rotating bichromal member electro-optic medium.

6. A method according to claim 4 wherein the electro-optic display comprises an encapsulated electrophoretic medium.

7. A method according to claim 4 wherein the electro-optic display comprises a microcell electrophoretic medium.

8. A method according to claim 1 wherein the electro-optic display comprises a layer of electro-optic material having first and second electrodes on opposed sides thereof, and the spacing between the first and second electrodes is at least about twice the spacing between adjacent pixels of the display.

9. A method according to claim 8 wherein the first electrode extends across a plurality of pixels, and a plurality of second electrodes are provided, each second electrode defining one pixel of the display, the second electrodes being arranged in a two-dimensional array.

10. A method according to claim 1 wherein the rewriting of the display is effected by applying to each pixel any one or more of the voltages −V, 0 and +V, where V is an arbitrary voltage.

11. A method according to claim 1 wherein the rewriting of the display is effected such that, for any series of transitions undergone by a pixel, the integral of the applied voltage with time is bounded.

12. A method according to claim 1 wherein the rewriting of the display is effected such that the impulse applied to a pixel during a transition depends only upon the initial and final gray levels of that transition.

13. A method according to claim 1 wherein at least one waveform has as its last period of non-zero voltage a series of pulses of alternating polarity.

14. A method according to claim 13 wherein the voltage applied during the pulses of alternating polarity is equal to the highest voltage used during the waveform.

15. A method according to claim 13 wherein the duration of each of the pulses of alternating polarity is not greater than about one-tenth of the duration of a pulse needed to drive a pixel from one extreme optical state to the other.

16. An electro-optic display having a plurality of pixels, each of which is capable of displaying at least three gray levels, at least one pixel electrode being associated with each pixel and capable of applying an electric field thereto, and drive means for applying waveforms to the pixel electrodes, the drive means being arranged so that, for all pixels undergoing non-zero transitions, the waveforms applied to the pixels have their last period of non-zero voltage terminating at substantially the same time; and wherein for all pixels undergoing zero transitions during which there is applied to that pixel at least one period of non-zero voltage, the last period of non-zero voltage applied to the pixel undergoing the zero transition terminates at substantially the same time as the last period of non-zero voltage applied to the pixels undergoing a non-zero transition.

17. A method of driving an electro-optic display having a plurality of pixels each of which is capable of displaying at least three gray levels, the method comprising:

displaying a first image on the display; and rewriting the display to display a second image thereon by applying to each pixel a waveform effective to cause the pixel to change from an initial gray level to a final gray level, wherein, for all pixels undergoing non-zero transitions, the waveforms applied to the pixels have their last period of non-zero voltage beginning at substantially the same time; and wherein at least one pixel undergoes a zero transition during which there is applied to that pixel at least one period of non-zero voltage, and wherein the last period of non-zero voltage applied to the pixel undergoing the zero transition terminates at substantially the same time as the last period of non-zero voltage applied to the pixels undergoing a non-zero transition.

18. A method according to claim 17 wherein the electro-optic display is bistable.

19. A method according to claim 18 wherein the electro-optic display comprises an electrochromic or rotating bichromal member electro-optic medium.

20. A method according to claim 18 wherein the electro-optic display comprises an encapsulated electrophoretic medium.

21. A method according to claim 18 wherein the electro-optic display comprises a microcell electrophoretic medium.

22. A method of driving an electro-optic display having a plurality of pixels each of which is capable of displaying at least three gray levels, the method comprising:

displaying a first image on the display; and rewriting the display to display a second image thereon by applying to each pixel a waveform effective to cause the pixel to change from an initial gray level to a final gray level, wherein, for all pixels undergoing non-zero transitions, the waveforms applied to the pixels have at least one voltage transition occurring at substantially the same time in each waveform, the waveforms for all pixels undergoing non-zero transitions being of the form $-x/\Delta IP/x$, where $\Delta IP$ denotes a difference in impulse potential between the final and initial states of the waveform, while −x and x represent a DC balanced pair of pulses.

23. A method according to claim 22 wherein, for all pixels undergoing non-zero transitions, the first voltage transition of the waveform occurs at substantially the same time in each waveform.

24. A method according to claim 22 wherein the beginning of the −x pulse occurs at substantially the same time in each waveform.

25. A method according to claim 22 wherein the beginning of the $\Delta IP$ pulse occurs at substantially the same time in each waveform.

26. A method according to claim 22 wherein the end of the x pulse occurs at substantially the same time in each waveform.

27. A method according to claim 22 wherein the electro-optic display is bistable.

28. A method according to claim 27 wherein the electro-optic display comprises an electrochromic or rotating bichromal member electro-optic medium.

29. A method according to claim 27 wherein the electro-optic display comprises an encapsulated electrophoretic medium.

30. A method according to claim 27 wherein the electro-optic display comprises a microcell electrophoretic medium.

31. A method according to claim 22 wherein the rewriting of the display is effected by applying to each pixel any one or more of the voltages −V, 0 and +V, where V is an arbitrary voltage.

* * * * *